US008449094B2

(12) United States Patent
Okubo

(10) Patent No.: US 8,449,094 B2
(45) Date of Patent: May 28, 2013

(54) LIQUID EJECTION HEAD UNIT AND LIQUID EJECTION APPARATUS

(75) Inventor: Katsuhiro Okubo, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/431,853

(22) Filed: Mar. 27, 2012

(65) Prior Publication Data

US 2012/0249684 A1 Oct. 4, 2012

(30) Foreign Application Priority Data

Mar. 29, 2011 (JP) ..... 2011-071848

(51) Int. Cl.
*B41J 2/17* (2006.01)

(52) U.S. Cl.
USPC ..... 347/94; 347/68; 347/70; 347/71

(58) Field of Classification Search
USPC ..... 347/94, 68, 70–72
See application file for complete search history.

(56) References Cited

U.S. PATENT DOCUMENTS

2005/0134645 A1 6/2005 Okazawa
2006/0256159 A1 11/2006 Owaki et al.
2009/0160907 A1 6/2009 Owaki et al.

FOREIGN PATENT DOCUMENTS

JP 2005-289074 A 10/2005
JP 2006-256006 A 9/2006

*Primary Examiner* — Matthew Luu
*Assistant Examiner* — Henok Legesse
(74) *Attorney, Agent, or Firm* — Kilpatrick Townsend & Stockton LLP

(57) ABSTRACT

Ink solvent having reached a buffer chamber through a manifold and a flexible portion is discharged in a direction different from the direction in which a holder opening is provided. Accordingly, the ink solvent is less likely to reach a connecting portion of a lead electrode and a COF substrate through the holder opening, a through-hole, and a support hole, through which the COF substrate extends. Thus, it is possible to make the solvent take a long time to reach the connecting portion, achieving an ink jet recording head in which the time taken to cause poor contact between the lead electrode and the COF substrate occurs is longer than that in the case where the solvent is discharged in the same direction as the direction in which the holder opening is provided.

8 Claims, 8 Drawing Sheets

LIQUID EJECTION HEAD UNIT AND LIQUID EJECTION APPARATUS

BACKGROUND

1. Technical Field

The present invention relates to a liquid ejection head unit having a liquid ejection head for ejecting liquid, and to a liquid ejection apparatus.

2. Related Art

JP-A-2005-289074 discloses a liquid ejection head having a flow-path forming substrate that forms pressure generating chambers communicating with nozzle openings, and an ink storage chamber, which serves as a manifold, i.e., an ink chamber, common to the pressure generating chambers. A nozzle plate provided with a plurality of nozzle openings is bonded to one surface of the flow-path forming substrate. A liquid ejection head unit includes a liquid ejection head like this.

A vibration plate is bonded to the other surface of the flow-path forming substrate, and piezoelectric vibrators, which serve as piezoelectric elements that change the pressure in the pressure generating chambers to discharge ink from the nozzle openings, are disposed so as to face the pressure generating chambers with the vibration plate therebetween. The vibration plate is made of a metal film and a resin film bonded together. Furthermore, a protection substrate for protecting the piezoelectric vibrators, a case head, etc., is provided on the other surface of the flow-path forming substrate.

A flexible wiring substrate is bonded to lead electrodes extending from the piezoelectric vibrators with an anisotropic conductive adhesive, such as an anisotropic conductive film (ACF) or an anisotropic conductive paste (ACP), in which conductive particles are dispersed in resin. The flexible wiring substrate, which extends through the case head, is connected to a control unit via a driving IC for the piezoelectric vibrators and a terminal of a connecting substrate.

A damper recess for absorbing pressure fluctuation in the manifold is provided in the case head or the like via the vibration plate, and the damper recess communicates with the outside through an external communication path formed in the case head or the like. Herein, an opening of the external communication path is provided so as to face a direction in which the flexible wiring substrate extends.

Furthermore, liquid, which contains solvent, is introduced into the manifold through a liquid introduction path.

However, because the opening of the external communication path is provided so as to face the direction in which the flexible wiring substrate extends, the liquid solvent reaches a connecting portion of the lead electrodes and the flexible wiring substrate through the opening, through which the flexible wiring substrate extends, and a space in which the flexible wiring substrate is stored, decomposing or swelling the resin used in the ACF or the like and causing poor contact at the connecting portion. Furthermore, if the opening of the external communication path is provided in a side surface of the case head or provided so as to face the nozzle plate, that is, provided in a direction different from the direction in which the flexible wiring substrate extends, liquid ejected from the nozzle plate easily enters the opening. As a result, the liquid blocks the external communication path, making it difficult to absorb pressure fluctuation in the manifold.

SUMMARY

An advantage of some aspects of the invention is that it can be embodied as the following embodiment or application examples.

Application Example 1

A liquid ejection head unit including: a flow-path forming substrate provided with pressure generating chambers communicating with nozzle openings, through which liquid is ejected, and a manifold communicating with the pressure generating chambers; pressure generating elements provided corresponding to the respective pressure generating chambers; a protection substrate accommodating the pressure generating elements and provided on the flow-path forming substrate; a damper portion facing the manifold with a compliance substrate therebetween; a buffer chamber communicating with the damper portion; an air open hole communicating with the damper portion and having an opening in the buffer chamber, at a position away from a bottom surface of the buffer chamber in the direction opposite to the gravity direction; an insertion hole extending from the flow-path forming substrate to the protection substrate; an opening provided in the buffer chamber so as to be oriented in a direction different from the direction in which the insertion hole is open; lead electrodes that extend from electrodes formed on the pressure generating elements and are exposed in the insertion hole; and a flexible wiring substrate connected at one end to the lead electrodes with an anisotropic conductive adhesive and extending through the insertion hole.

In this application example, the buffer chamber has an opening oriented in a direction different from the direction in which the insertion hole, through which the flexible wiring substrate extends, is open. Thus, liquid solvent having reached the buffer chamber through the manifold and the compliance substrate is discharged in a direction different from the direction in which the insertion hole is open. Accordingly, the liquid solvent is less likely to reach the connecting portion of the lead electrodes and the flexible wiring substrate through the insertion hole, through which the flexible wiring substrate extends. Thus, it is possible to make the solvent take a long time to reach the connecting portion, achieving a liquid ejection head in which the time taken to cause poor contact between the lead electrodes and the flexible wiring substrate is longer than that in the case where the solvent is discharged in the same direction as the direction in which the insertion hole is open.

Furthermore, the liquid having entered from the opening in the buffer chamber stays on the bottom surface of the buffer chamber due to the gravity. Herein, because the opening of the air open hole, through which the damper portion communicates with the buffer chamber, is provided away from the bottom surface in the direction opposite to the gravity direction, the liquid is less likely to enter the air open hole. Thus, flow of air into and out of the damper portion is less likely to be prevented, whereby a liquid ejection head unit can be obtained in which pressure fluctuation in the manifold is smoothly absorbed by the compliance substrate.

Application Example 2

In the above-described liquid ejection head unit, a portion of the air open hole is formed so as to protrude in the buffer chamber.

In this application example, because a portion of the air open hole is formed so as to protrude in the buffer chamber, the liquid is less likely to flow from the bottom surface of the buffer chamber toward the opening of the air open hole. Thus, the liquid is less likely to enter the air open hole. Thus, flow of air into and out of the damper portion is even less likely to be prevented, whereby a liquid ejection head unit can be obtained in which pressure fluctuation in the manifold is more smoothly absorbed by the compliance substrate.

Application Example 3

In the above-described liquid ejection head unit, the air open hole is formed in an inner surface of a notch formed in a side surface of the buffer chamber, at a position away from the bottom surface of the buffer chamber in the direction opposite to the gravity direction.

In this application example, the notch formed in the side surface of the buffer chamber can be formed, as a part of the buffer chamber, simultaneously with the formation of the buffer chamber. Thus, a liquid ejection head unit, in which the buffer chamber is easy to form, can be obtained.

Application Example 4

The above-described liquid ejection head unit, further including: a support member provided on the compliance substrate and provided with a portion of the damper portion; and a holder member provided with the buffer chamber and bonded to the top of the support member, wherein the insertion hole includes a through-hole penetrating the protection substrate in the thickness direction from the flow-path forming substrate to the support member; a support hole continuous with the through-hole and penetrating the support member in the thickness direction from the support member to the holder member; and an opening continuous with the support hole and penetrating the holder member in the thickness direction.

In this application example, because the support member provided with a portion of the damper portion and the holder member provided with the buffer chamber are separate members, a portion of the damper portion and the buffer chamber are easy to form. Furthermore, the insertion hole, through which the flexible wiring substrate is inserted, is formed by stacking the protection substrate, the support member, and the holder member, which include the through-hole formed in the protection substrate, the support hole formed in the support member, and the holder opening formed in the holder member. Thus, an easy-to-manufacture liquid ejection head unit can be obtained.

Application Example 5

A liquid ejection apparatus including the above-described liquid ejection head unit.

With this application example, a liquid ejection apparatus having the above-described advantages can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

The following description will be given by taking as an example a liquid ejection head unit according to an embodiment, which is installed on a printer 1000 serving as a liquid ejection apparatus.

Figure 1:
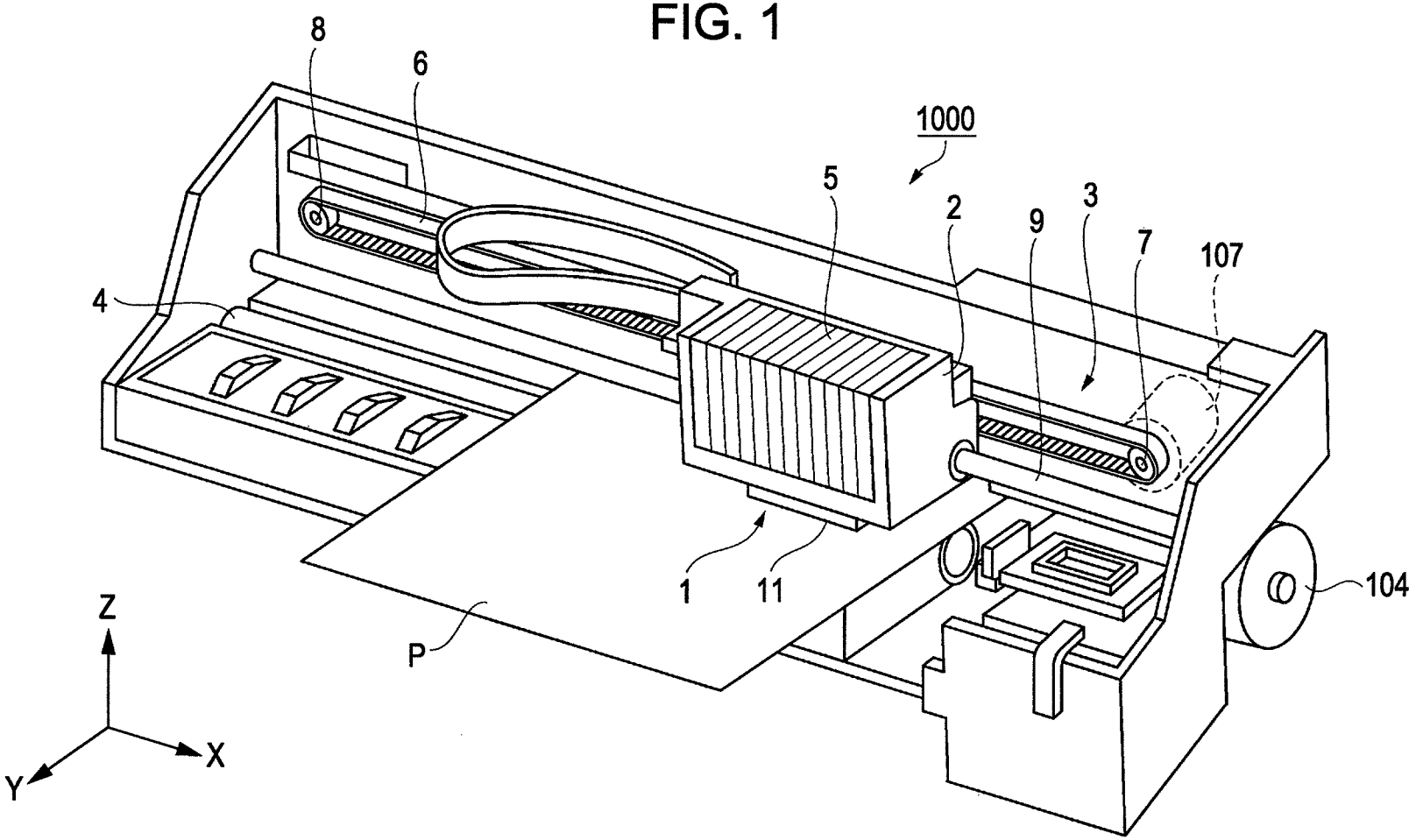
FIG. 1 is a schematic view illustrating the configuration of a printer according to an embodiment.

FIG. 1 is a schematic view illustrating the configuration of the printer 1000. In FIG. 1, the direction X corresponds to a main scanning direction in which a carriage 2 moves, the direction Y corresponds to a sub-scanning direction in which a recording medium P is transported, and the direction Z is perpendicular to the directions X and Y. When the directions X and Y are on a horizontal plane, the direction Z is the gravity direction. However, depending on how the printer 1000 is placed, the direction Z may not be the gravity direction.

As illustrated in FIG. 1, the printer 1000 includes an ink jet recording head unit 11, which serves as a liquid ejection head unit and has a plurality of ink jet recording heads 1 (not shown in FIG. 1), a carriage 2, a carriage moving mechanism 3, a platen roller 4, and ink cartridges 5.

The ink jet recording heads 1 are attached to the ink jet recording head unit 11, on the side facing a recording medium P, such as a recording sheet, (the lower surface in the direction Z in FIG. 1) and discharge ink droplets onto the surface of the recording medium P.

The carriage moving mechanism 3 includes a timing belt 6, a driving pulley 7, a driven pulley 8, and a motor 107. The timing belt 6, to which the carriage 2 is attached, is stretched over the driving pulley 7 and the driven pulley 8. The driving pulley 7 is connected to the output shaft of the motor 107.

When the motor 107 is activated, the carriage 2, while being guided by a guide rod 9 extending in the printer 1000, reciprocates in the direction X, which is the main scanning direction. A platen roller 4 receives a driving force from a motor 104 and transports a recording medium P in the direction Y, which is the sub-scanning direction.

The ink cartridges 5, which store ink, are removably attached to the carriage 2. The ink cartridges 5 supply ink to the ink jet recording heads 1. When multiple colors of ink are to be supplied, multiple ink cartridges 5 are attached to the carriage 2. In FIG. 1, ten ink cartridges 5 are attached to the carriage 2.

The thus-configured printer 1000 can record an image on the recording medium P by discharging ink from the ink jet recording heads 1 attached to the carriage 2, while reciprocating the carriage 2 in the direction X by the carriage moving mechanism 3 and transporting the recording medium P in the direction Y by the platen roller 4.

Referring to FIGS. 2 and 3A to 3C, the ink jet recording heads 1 and the ink jet recording head unit 11 will be described.

Figure 2:
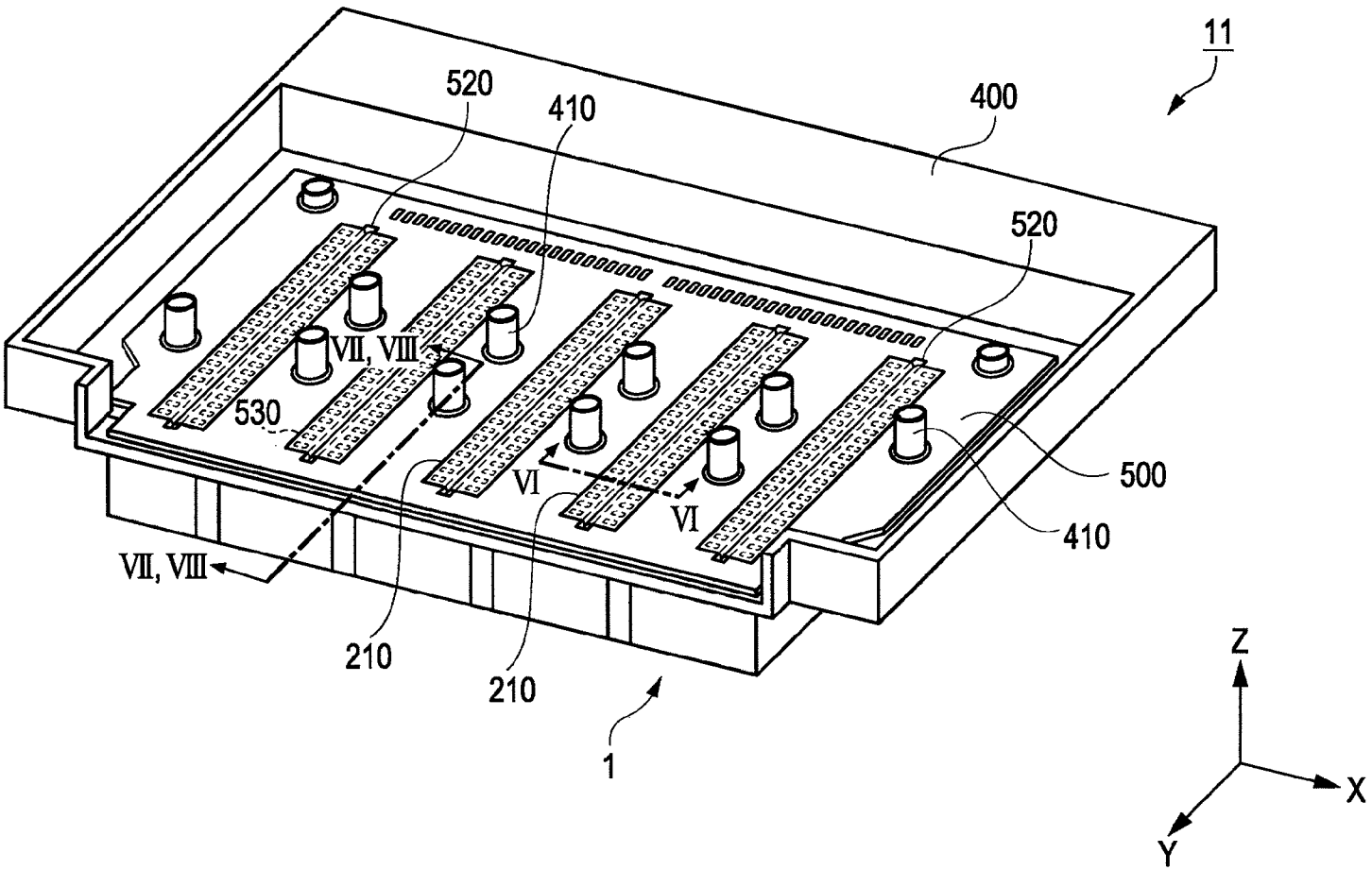
FIG. 2 is a perspective view of an ink jet recording head unit.
Figure 3A:
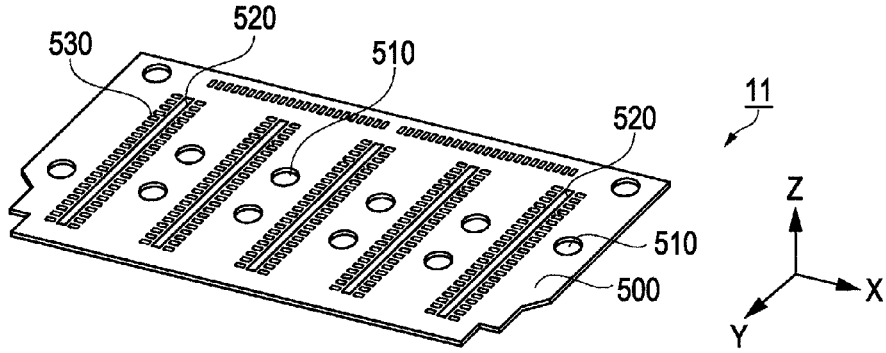
FIGS. 3A to 3C are exploded perspective views of the ink jet recording head unit.
Figure 3B:
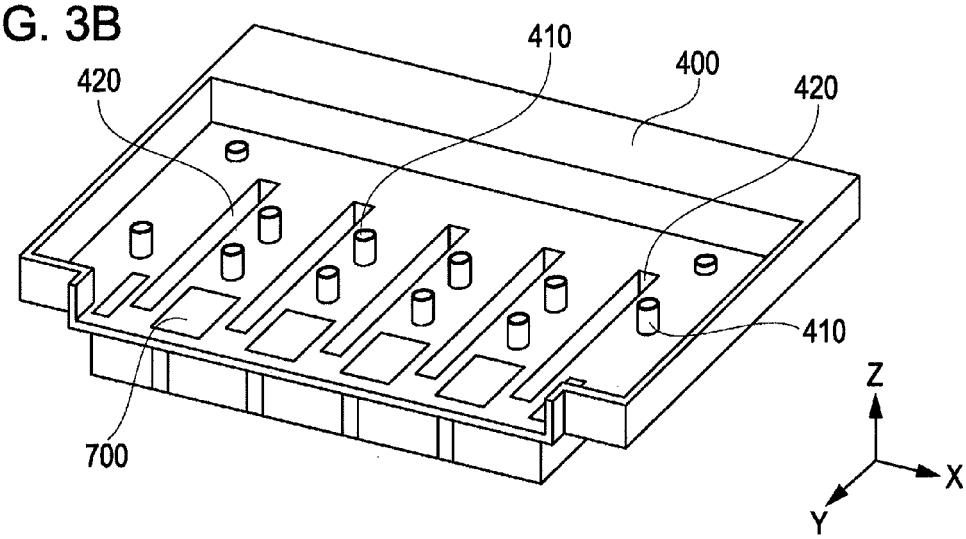
Figure 3C:
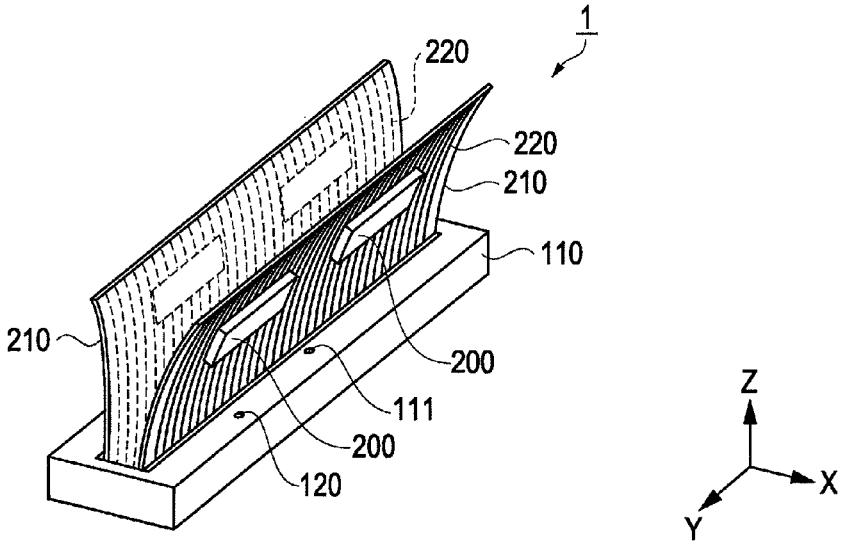

FIG. 2 is a perspective view of the ink jet recording head unit 11 according to an embodiment, and FIGS. 3A to 3C are exploded perspective views of the ink jet recording head unit 11.

FIG. 3C illustrates, in a larger scale, only one ink jet recording head 1 before being incorporated into the ink jet recording head unit 11. In actuality, five ink jet recording heads 1 are incorporated into the ink jet recording head unit 11.

In FIGS. 2 and 3A to 3C, each ink jet recording head 1 corresponds to two colors of ink, and hence, ten colors of ink are discharged by five ink jet recording heads 1 in this embodiment.

The number of ink jet recording heads 1 incorporated into the ink jet recording head unit 11 depends on how many colors of ink are to be discharged, and thus, not limited to five.

The ink jet recording head unit 11 includes a holder member 400 and a relay substrate 500.

The holder member 400 has ten ink introduction paths 410, which serve as liquid introduction paths, corresponding to five ink jet recording heads 1. Furthermore, the relay substrate 500 has holes 510, through which the ink introduction paths 410 extend.

The relay substrate 500 is fitted to the holder member 400 from one side thereof, such that the ink introduction paths 410 extend through the holes 510.

In FIG. 3C, the ink jet recording head 1 includes a case head 110, which serves as a support member, and a pair of chip-on-film (COF) substrates 210, which serve as flexible wiring substrates. Furthermore, the COF substrates 210 each have a plurality of wires 220 and driving circuits 200.

In FIGS. 2 and 3A to 3C, the ink jet recording heads 1 are fitted to the holder member 400 from the recording medium P side (the lower surface side in the direction Z in FIG. 1), i.e., the side opposite to the side provided with the relay substrate 500. The holder member 400 has five holder openings 420 corresponding to the ink jet recording heads 1 to be fitted thereto, and the relay substrate 500 has five slits (openings) 520. The COF substrates 210, forming pairs, are inserted through the holder openings 420 and the slits 520, and the wires 220 are bonded to terminals 530 on the relay substrate 500.

Furthermore, in FIG. 3C, the case head 110 has ink introduction paths 111, which serve as liquid introduction paths, that are connected to the ink introduction paths 410 to introduce ink into the ink jet recording head 1. The case head 110 also has external communication paths 120 that communicate with damper portions 47 described below (see FIG. 6).

Figure 4:
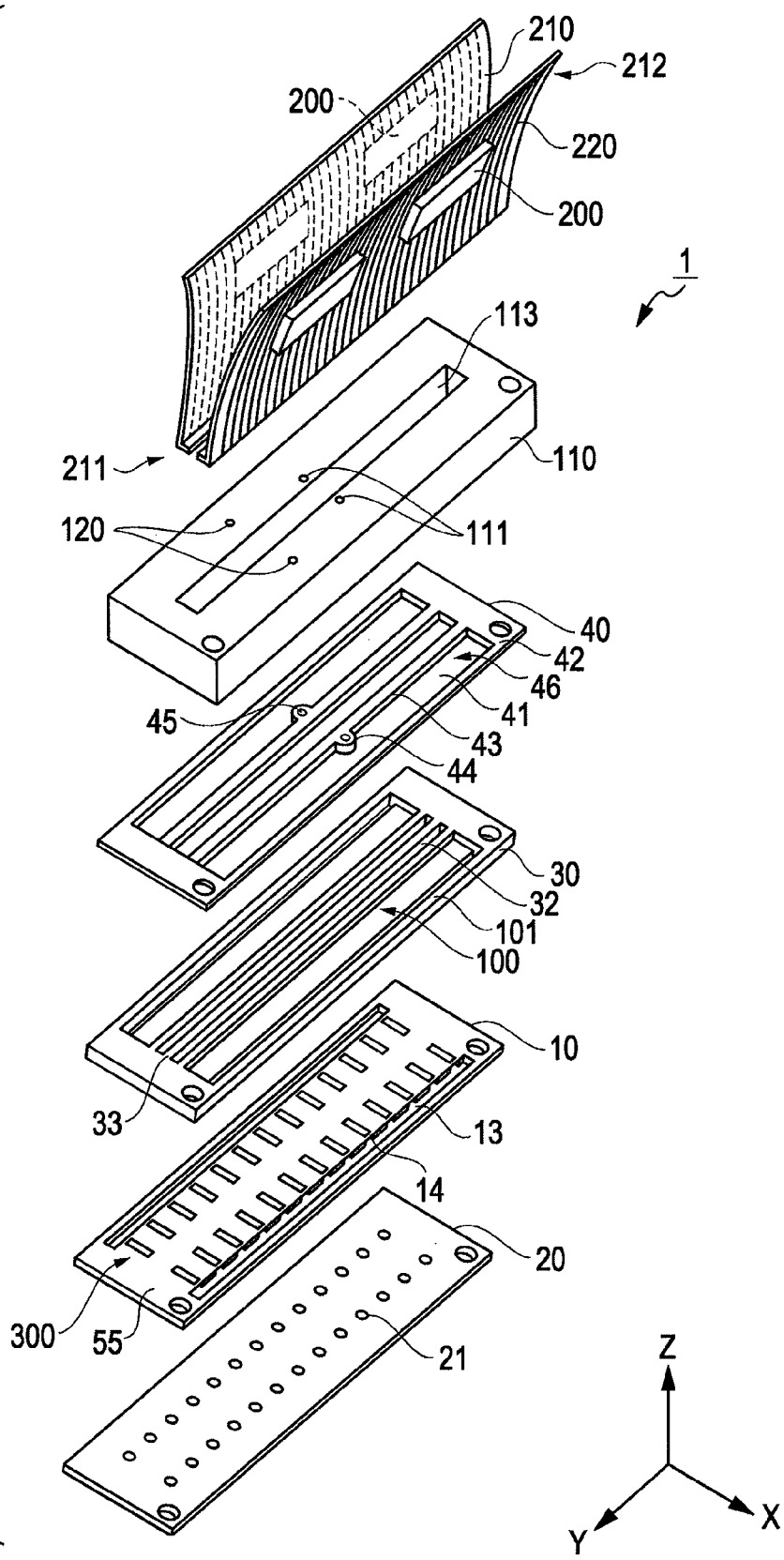
FIG. 4 is an exploded perspective view of the ink jet recording head.
Figure 5:
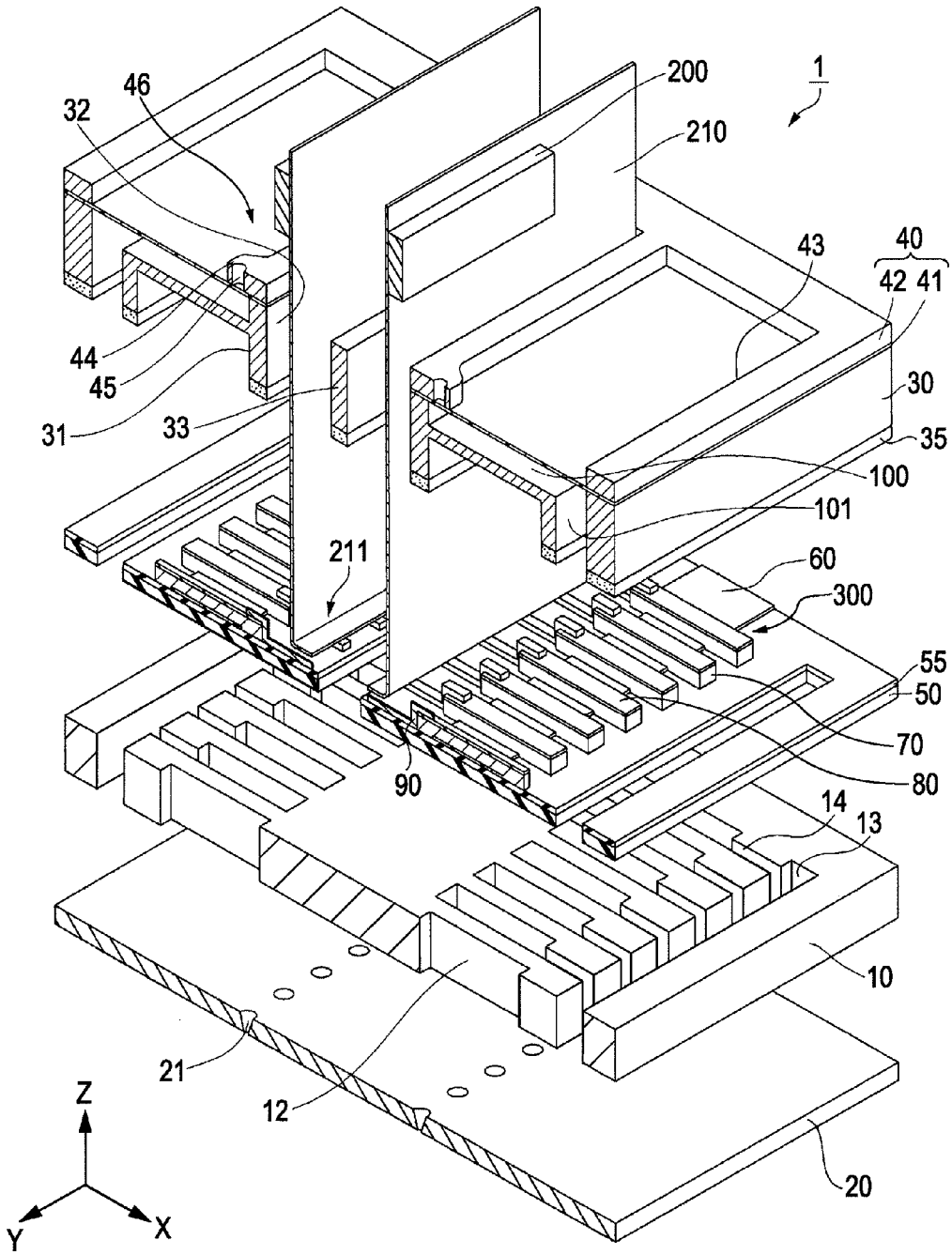
FIG. 5 is an exploded cross-sectional perspective view of a portion of the ink jet recording head.

FIG. 4 is an exploded perspective view of the ink jet recording head 1 before being incorporated into the holder member 400 and the relay substrate 500. FIG. 5 is an exploded cross-sectional perspective view of a portion of the ink jet recording head 1. FIG. 5 does not show the case head 110.

Figure 6:
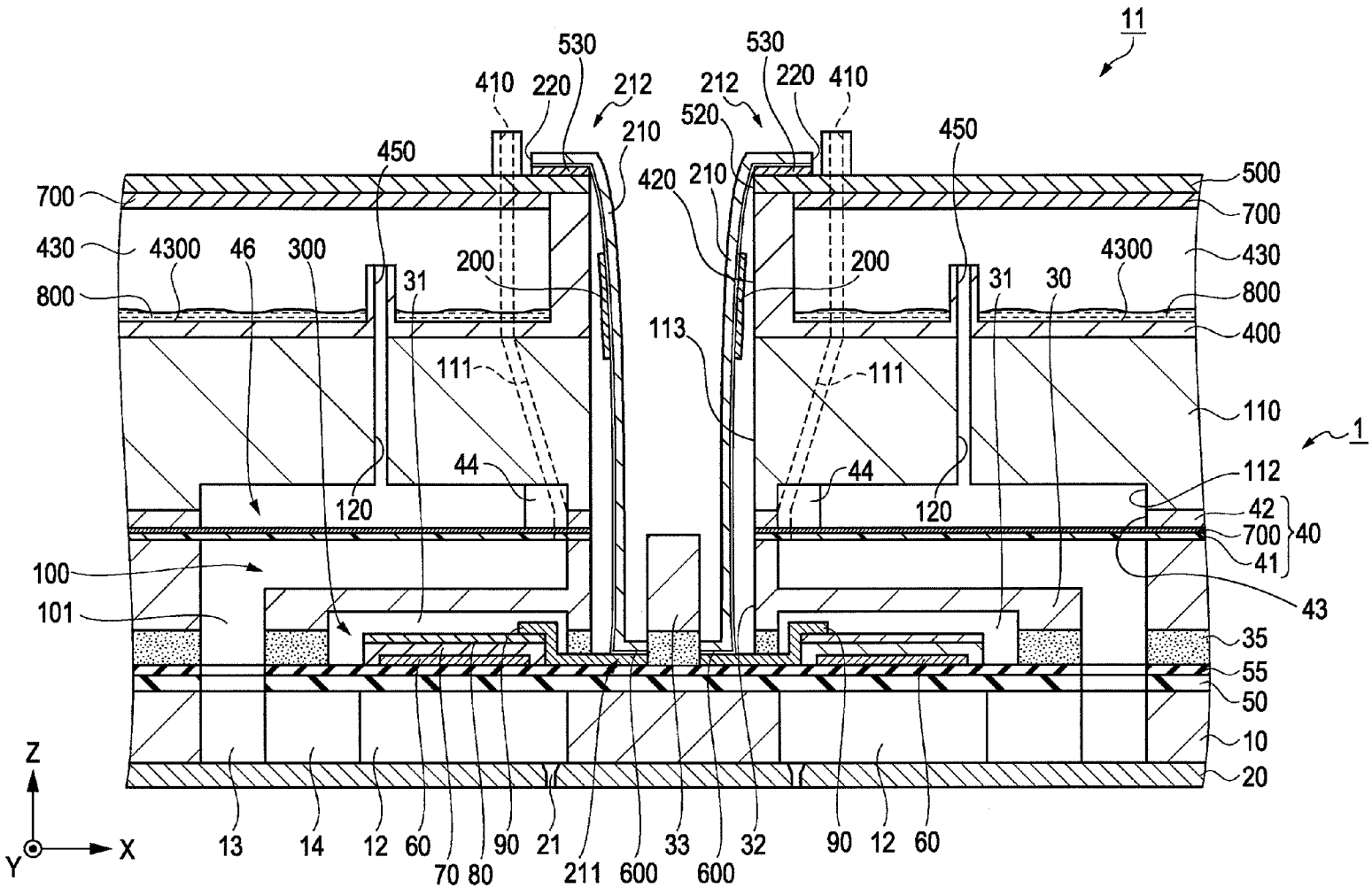
FIG. 6 is a cross-sectional view of the ink jet recording head unit in FIG. 2, taken along line VI-VI.
Figure 7:
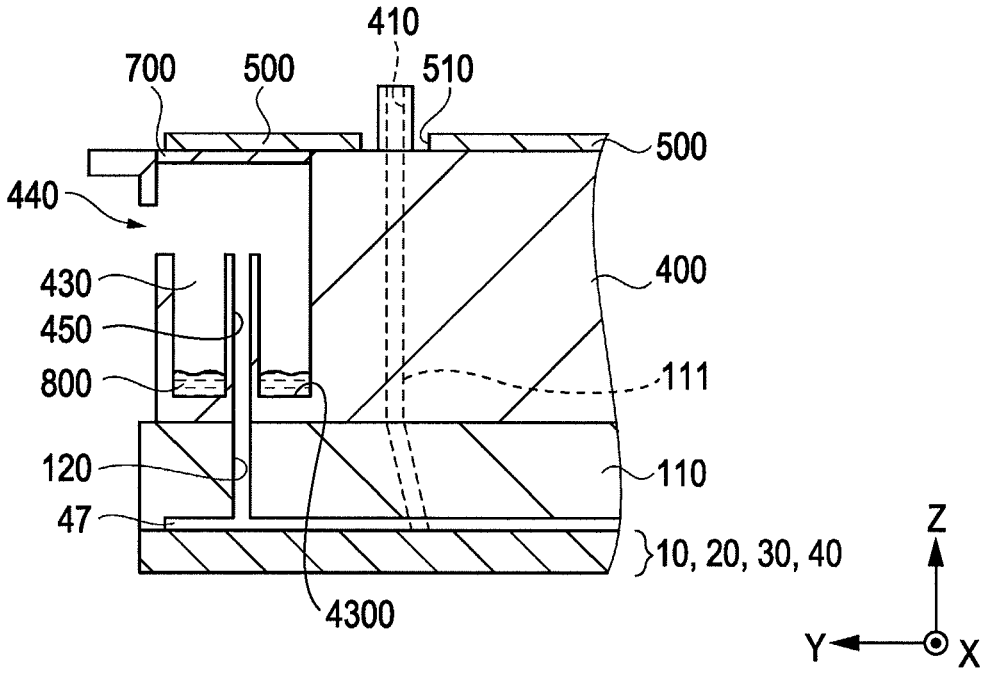
FIG. 7 is a cross-sectional view of the ink jet recording head unit in FIG. 2, taken along line VII-VII.

FIG. 6 is a cross-sectional view of the ink jet recording head unit 11 in FIG. 2, taken along line VI-VI, and FIG. 7 is a cross-sectional view of the ink jet recording head unit 11 in FIG. 2, taken along line VII-VII.

In FIGS. 4, 5, and 6, the ink jet recording head 1 includes a flow-path forming substrate 10, a nozzle plate 20, a protection substrate 30, a compliance substrate 40, and a pair of the COF substrates 210 provided with the driving circuits 200.

The flow-path forming substrate 10, the nozzle plate 20, and the protection substrate 30 are stacked such that the flow-path forming substrate 10 is between the nozzle plate 20 and the protection substrate 30, and the compliance substrate 40 is disposed on the protection substrate 30.

The COF substrates 210 each have a first end 211 and a second end 212, which is located opposite the first end 211. In FIG. 6, the first ends 211 of the COF substrates 210 are inserted through the protection substrate 30, and the second ends 212 are connected to the relay substrate 500.

The flow-path forming substrate 10 is made of, for example, a silicon single crystal substrate having a plane direction (110). An elastic film 50 made of, for example, silicon dioxide is formed on one surface thereof.

The flow-path forming substrate 10 may be made of a material other than the silicon single crystal substrate, and, for example, a metal plate or a ceramic plate may be used.

The flow-path forming substrate 10 has a plurality of pressure generating chambers 12 defined by partition walls and provided in two rows arranged side-by-side in the width direction thereof. Each pressure generating chamber 12 is paired with a corresponding one in the other row.

Furthermore, communication portions 13 are provided on the outer side of the rows of the pressure generating chambers 12 in the longitudinal direction thereof, and the communication portions 13 communicate with the pressure generating chambers 12 through ink supply paths 14 provided corresponding to the respective pressure generating chambers 12. The communication portions 13 communicate with supply portions 101 of the protection substrate 30, forming portions of manifolds 100, which serve as ink chambers each common to a row of the pressure generating chambers 12.

The ink supply paths 14, which have a smaller width than the pressure generating chambers 12, maintain the flow path resistance for ink flowing from the communication portions 13 into the pressure generating chambers 12 constant.

Although the ink supply paths 14 are formed such that the width of the flow paths is reduced from one side in this embodiment, the ink supply paths 14 may be formed such that the width of the flow paths is reduced from both sides. Furthermore, the ink supply paths 14 may be formed by reducing the thickness, not the width, of the flow paths.

Furthermore, the nozzle plate 20 provided with nozzle openings 21, which communicate with ends of the pressure generating chambers 12 opposite the ends provided with the ink supply paths 14, is bonded, with an adhesive or a heat welding film, to a surface of the flow-path forming substrate 10 opposite the surface provided with the elastic film 50. In this embodiment, because the flow-path forming substrate 10 is provided with two rows of the pressure generating chambers 12 arranged side-by-side, one ink jet recording head 1 has two rows of the nozzle openings 21 arranged side-by-side. The nozzle plate 20 is made of, for example, glass ceramic, a silicon single crystal substrate, or stainless steel.

On the other hand, an insulating film 55 is formed on the elastic film 50 that is formed on the flow-path forming substrate 10. Furthermore, lower electrodes 60 composed of metal, such as platinum (Pt), or metaloxide, such as strontium ruthenate (SrRuO), piezoelectric layers 70 having a perovskite structure, and upper electrodes 80 composed of metal, such as gold (Au) or iridium (Ir), are formed on the insulating film 55, forming piezoelectric elements 300, which serve as pressure generating elements.

Herein, the piezoelectric elements 300 refer to portions each include the lower electrode 60, the piezoelectric layer 70, and the upper electrode 80. The piezoelectric elements 300 form pairs corresponding to the pairs of the pressure generating chambers 12.

Furthermore, herein, the piezoelectric elements 300 and a vibration plate, which is displaced by driving the piezoelectric elements 300, are collectively referred to as an actuator device. In the example above, the elastic film 50, the insulating film 55, and the lower electrodes 60 serve as the vibration plate. However, it is of course not limited thereto, and it is possible that, for example, only the lower electrodes 60 may serve as the vibration plate, without providing the elastic film 50 and the insulating film 55. Alternatively, the piezoelectric elements 300 themselves may serve as the vibration plate.

Usually, the lower electrodes 60 or the upper electrodes 80 of the piezoelectric elements 300 are used as the common electrode, and the remaining electrodes and the piezoelectric layers 70 are patterned on the pressure generating chambers 12. Herein, portions that are formed of the patterned electrodes and the piezoelectric layers 70 and cause piezoelectric strain when a voltage is applied to both electrodes are referred to as piezoelectric active portions.

Although the lower electrodes 60 are used as the common electrode and the upper electrodes 80 are used as the individual electrodes of the piezoelectric elements 300 in this embodiment, these functions may be reversed, depending on how the driving circuits and the wires are arranged. In any case, the piezoelectric active portions are formed for the respective pressure generating chambers 12.

Furthermore, lead electrodes 90 composed of, for example, gold (Au), which extend over the insulating film 55, are connected to the upper electrodes 80, which serve as individual electrodes, of the piezoelectric elements 300. The lead electrodes 90 form pairs corresponding to the pairs of the piezoelectric elements 300. Ends on one side of the lead electrodes 90 are connected to the upper electrodes 80, and ends on the other side of the lead electrodes 90 extend to positions between the parallel rows of the piezoelectric elements 300.

Furthermore, the protection substrate 30 having piezoelectric-element accommodating portions 31, which have spaces large enough not to prevent the movement of the piezoelectric elements 300, in the areas facing the piezoelectric elements 300 is bonded, with an adhesive 35 or the like, to the top of the flow-path forming substrate 10 provided with the piezoelectric elements 300. Because the piezoelectric elements 300 are accommodated in the piezoelectric-element accommodating portions 31, the piezoelectric elements 300 are protected and not affected by the external environment. The piezoelectric-element accommodating portions 31 may be either sealed or unsealed. Furthermore, the piezoelectric-element accommodating portions 31 may be provided either individually for the respective piezoelectric elements 300 or continuously for a plurality of piezoelectric elements 300. In this embodiment, the piezoelectric-element accommodating portions 31 are continuously provided for a plurality of piezoelectric elements 300.

Furthermore, portions of the manifolds 100, which serve as the common ink chambers (liquid chambers) for a plurality of individual flow paths, are provided in the protection substrate 30, at portions facing the piezoelectric-element accommodating portions 31. In this embodiment, portions of the manifolds 100 are formed in the shape of a recess provided in the surface opposite the surface at which the protection substrate 30 and the flow-path forming substrate 10 are bonded together.

The protection substrate 30 has recesses in the surface opposite the surface bonded to the flow-path forming substrate 10, and the openings of the recesses are sealed by the compliance substrate 40. Note that the manifolds 100 continuously extend in a transverse direction (width direction) of the individual flow paths.

Furthermore, the manifolds 100 extend up to positions near the ends of the protection substrate 30 in the longitudinal direction of the pressure generating chambers 12, and the ends of the manifolds 100 on one side are provided at positions facing the ends of the individual flow paths. By providing the manifolds 100 above the piezoelectric-element accommodating portions 31 (in areas overlapping the piezoelectric-element accommodating portions 31 in plan view) in this manner, the manifolds 100 do not need to be extended to the outer side of the pressure generating chambers 12 in the longitudinal direction thereof. Thus, the ink jet recording heads 1 can be reduced in size by reducing the width thereof in the longitudinal direction of the pressure generating chambers 12.

Furthermore, a through-hole 32 penetrating the protection substrate 30 in the thickness direction is provided substantially at the center of the protection substrate 30, i.e., the area where the paired pressure generating chambers 12 face each other. A partition portion 33 is provided at the center of the through-hole 32.

The other ends of the lead electrodes 90 opposite the ends connected to the upper electrodes 80 are exposed at the bottom of the through-hole 32. The lead electrodes 90 exposed in the through-hole 32 are electrically connected to the wires 220, formed on the COF substrates 210 inserted through the through-hole 32, at the first ends 211. The lead electrodes 90 are bonded to the wires 220 with, for example, an anisotropic conductive adhesive, ACP600.

Because the use of ACP600 enables a plurality of lead electrodes 90 to be bonded to one COF substrate 210, the processing time can be reduced compared with wire bonding, in which the lead electrodes 90 are sequentially connected to the COF substrate 210, and hence, the cost can be reduced.

The COF substrates 210 are flexible substrates, and the first ends 211 to be connected to the lead electrodes 90 are bent in a substantially L shape. The first ends 211 are disposed toward the piezoelectric elements 300 facing thereto. The piezoelectric elements 300 are driven by the driving circuits 200 mounted on the COF substrates 210.

The protection substrate 30 is made of, for example, glass, ceramic material, metal, or resin. It is more preferable that the protection substrate 30 be made of a material having substantially the same coefficient of thermal expansion as the flow-path forming substrate 10. In this embodiment, the protection substrate 30 is made of a silicon single crystal substrate, which is the same material as the material of the flow-path forming substrate 10.

The compliance substrate 40 includes a sealing film 41 and a fixing plate 42. The sealing film 41 is made of a flexible material having low rigidity, for example, a polyphenylene sulfide (PPS) film having a thickness of about several μm. The fixing plate 42 is made of a hard material, for example, metal, such as a stainless steel (SUS) plate having a thickness of about several tens μm.

In FIG. 6, the sealing film 41 and the fixing plate 42 are bonded together with a bonding adhesive 700.

The fixing plate 42 is provided around the manifolds 100 in the protection substrate 30, and areas facing the manifolds 100 serve as fixing plate openings 43, where the fixing plate 42 is completely removed in the thickness direction.

Furthermore, in FIGS. 4 and 5, the fixing plate 42 has projections 44 protruding into the fixing plate openings 43, and the projections 44 each have an ink introduction port 45 penetrating in the thickness direction, which serves as a liquid introduction port through which ink is supplied from the ink cartridge 5 shown in FIG. 1, where ink is stored, to the manifold 100.

As illustrated in FIGS. 4 and 5, in this embodiment, the projections 44 are provided on the opposite side from the supply portions 101, such that portions thereof in the direction in which the rows of the pressure generating chambers 12 are arranged protrude up to areas facing the manifolds 100.

Therefore, the ink introduction ports 45 are provided at ends opposite from the supply portions 101 provided in the protection substrate 30, in the longitudinal direction of the pressure generating chambers 12. By providing the ink introduction ports 45 at the ends opposite from the supply portions 101 of the protection substrate 30 in this manner, the risk of the dynamic pressure of ink introduced from the ink cartridges 5 shown in FIG. 1 affecting the pressure generating chambers 12 via the supply portions 101 can be reduced.

Because of the fixing plate openings 43 in the fixing plate 42, one surface of each manifold 100 constitutes a deformable flexible portion 46 sealed by the flexible sealing film 41 and the bonding adhesive 700. It is also possible that the flexible portion 46 is made only of the sealing film 41.

In this embodiment, the flexible portions 46 are provided in the areas facing the supply portions 101 of the protection substrate 30 in the areas facing the manifolds 100, and around the ink introduction ports 45 in the fixing plate 42 in the areas facing the manifolds 100. The flexible portions 46 are provided in a continuous manner in the areas facing the supply portions 101 and around the ink introduction ports 45. By providing the flexible portions 46 in the areas facing the supply portions 101 and around the ink introduction ports 45, large flexible portions 46 can be formed. Thus, the compliance in the manifolds 100 can be increased, thereby reliably reducing cross talk caused by the negative influence of pressure fluctuation.

Furthermore, the case head 110 is provided on the compliance substrate 40. The case head 110 has the ink introduction paths 111 communicating with the ink introduction ports 45 formed in the projections 44 shown in FIG. 4, through which ink is supplied from the ink storage portions, such as the ink cartridges 5 shown in FIG. 1, to the manifolds 100.

Furthermore, the case head 110 has recesses 112 in the areas facing the fixing plate openings 43 to allow appropriate deflection of the fixing plate openings 43.

Furthermore, the case head 110 has a support hole 113 communicating with the through-hole 32 provided in the protection substrate 30.

The first ends 211 of the COF substrates 210 are inserted through the support hole 113 and the through-hole 32, and the wires 220 at the first ends 211 are connected to the lead electrodes 90.

Note that the COF substrates 210 may be supported by a molding material filled in the through-hole 32 and the support hole 113.

Furthermore, in FIGS. 6 and 7, the case head 110 has the damper portions 47, which serve as damper recesses, in the areas facing the fixing plate openings 43 to allow appropriate deflection of the flexible portions 46.

Furthermore, the case head 110 has the support hole 113 that communicates with the through-hole 32 provided in the protection substrate 30.

In FIG. 6, the second ends 212 of the COF substrates 210, which are located opposite the first ends 211, are inserted through the holder opening 420 in the holder member 400 and the slit 520 in the relay substrate 500, and the wires 220 at the second ends 212 are connected to the terminals 530 on the relay substrate 500.

In FIGS. 6 and 7, the external communication paths 120 shown in FIGS. 3 and 4 are formed in the case head 110 so as to communicate with the damper portions 47. The external communication paths 120 communicate with air open holes 450 formed in the holder member 400.

The case head 110 is made of, for example, resin mainly composed of PPS, or metal.

The holder member 400 has buffer chambers 430 communicating with the air open holes 450. The air open holes 450, which have a tubular shape in the buffer chambers 430, protrude in the buffer chambers 430 and open in the middle of the buffer chambers 430.

Furthermore, in FIG. 7, the buffer chambers 430 each have an opening 440 in a side surface of the holder member 400 so as to communicate with the outside.

The buffer chambers 430 may be formed by providing recesses, which constitute part of the buffer chambers 430, in the holder member 400 and covering the recesses with lids 700. The lids 700 are shown also in FIG. 3B.

As described above, the first ends 211 of the COF substrates 210 are inserted through the holder opening 420, the support hole 113, and the through-hole 32, which together serve as the insertion hole, and the wires 220 at the first ends 211 are connected to the lead electrodes 90.

The COF substrates 210 may be supported by filling the through-hole 32 and the support hole 113 with a molding material.

In the ink jet recording heads 1, ink is introduced from the ink cartridges 5 shown in FIG. 1. Then, after the inside, specifically, the portions from the manifolds 100 to the nozzle openings 21, is filled with ink, a voltage is applied between the lower electrodes 60 and the upper electrodes 80, which correspond to the pressure generating chambers 12, according to a driving signal from the driving circuits 200. Upon being subjected to a voltage, the elastic film 50 and the piezoelectric layers 70 are deflected, increasing the pressure in the pressure generating chambers 12 and discharging ink droplets from the nozzle openings 21. Examples of the solvent for ink include diethylene glycol diethyl ether and diethylene glycol methylethyl ether.

The driving signal includes, for example, driving signals, such as driving power source signals, for driving the driving IC, and various control signals, such as serial signals (SI). The wires include a plurality of wires for supplying the respective signals.

This embodiment provides the following advantages.

(1) Because the buffer chambers 430 have the openings 440 oriented in a direction different from the direction in which the holder openings 420, the through-holes 32, and the support holes 113, through which the COF substrates 210 extend, are open, the ink solvent having reached the buffer chambers 430 through the manifolds 100 and the flexible portions 46 is discharged in a direction different from the direction in which the holder openings 420 are open. Accordingly, the ink solvent is less likely to reach the connecting portions of the lead electrodes 90 and the COF substrates 210 through the holder openings 420, the through-holes 32, and the support holes 113, through which the COF substrates 210 extend. Thus, it is possible to make the solvent take a long time to reach the connecting portion, achieving the ink jet recording heads 1 in which the time taken to cause poor contact between the lead electrodes 90 and the COF substrates 210 occurs is longer than that in the case where the solvent is discharged in the same direction as the direction in which the holder openings 420 are provided. Furthermore, ink 800 having entered from the openings 440 in the buffer chambers 430 stays on bottom surfaces 4300 of the buffer chambers 430 due to the gravity. Herein, because the openings of the air open holes 450, through which the damper portions 47 and the buffer chambers 430 communicate with each other, are located away from the bottom surfaces 4300 in the direction opposite to the gravity direction, the ink 800 is less likely to enter the air open holes 450. Thus, flow of air into and out of the damper portions 47 is less likely to be prevented, whereby an ink jet recording head unit 11 in which pressure fluctuation in the manifolds 100 is smoothly absorbed by the flexible portions 46 can be obtained.

(2) Because portions of the air open holes 450 protrude in the buffer chambers 430, the ink 800 is less likely to flow from the bottom surfaces 4300 of the buffer chambers 430 toward the openings of the air open holes 450. Thus, the ink 800 is less likely to enter the air open holes 450. Thus, flow of air into and out of the damper portions 47 is even less likely to be prevented, whereby an ink jet recording head unit 11 in which pressure fluctuation in the manifolds 100 is more smoothly absorbed by the flexible portions 46 can be obtained.

(3) Because the case head 110, in which a portion of the damper portions 47 is formed, and the holder member 400, in which the buffer chambers 430 are formed, are separate members, the portion of the damper portions 47 and the buffer chambers 430 are easy to form. Furthermore, the insertion hole, through which the COF substrates 210 are inserted, can be formed by stacking the protection substrate 30, the case head 110, and the holder member 400, which include the through-hole 32 provided in the protection substrate 30, the support hole 113 provided in the case head 110, and the holder openings 420 provided in the holder member 400. Thus, an easy-to-manufacture ink jet recording head unit 11 can be obtained.

(4) The printer 1000 having the above-described advantages can be obtained.

First Modification

Figure 8:
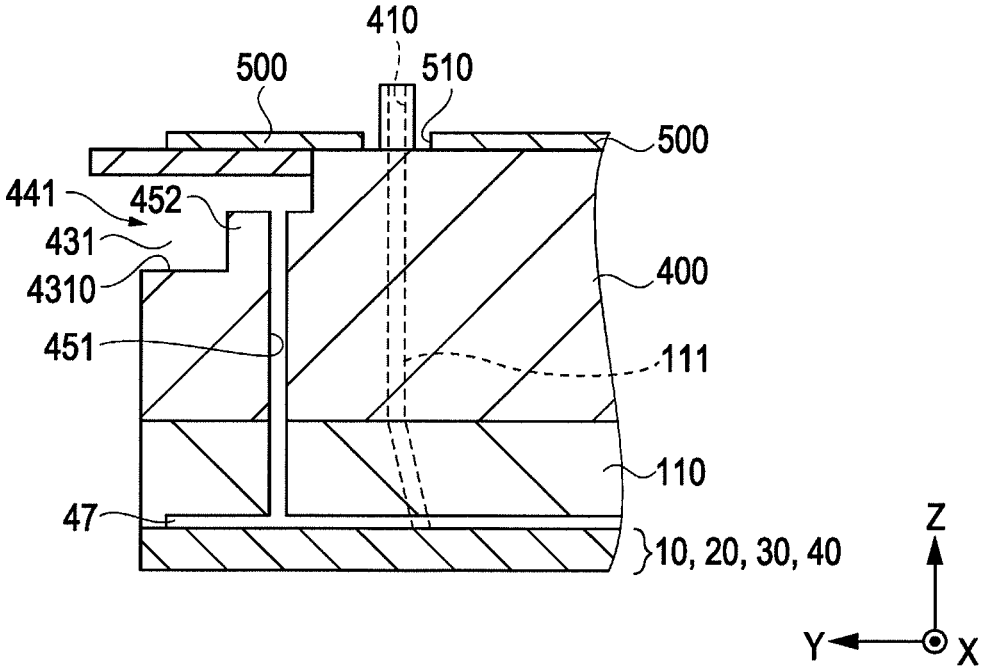
FIG. 8 is a cross-sectional view of an ink jet recording head unit according to a first modification.

FIG. 8 is a cross-sectional view of the ink jet recording head unit 11 according to a first modification, taken along line VIII-VIII in FIG. 2.

In FIG. 8, a buffer chamber 431 is formed in the shape of a recess in a side surface of the holder member 400 and has an opening 441 in the side surface. The buffer chamber 431 has a step portion 452 in the direction Z. An air open hole 451 is formed in the step portion 452 so as to open in the direction Z (the direction opposite to the gravity direction).

The first modification provides the following advantages.

(5) The lids 700 in the embodiment are unnecessary. Thus, an easy-to-manufacture ink jet recording head unit 11 can be obtained, because the structure of the buffer chamber 431 is simple.

Second Modification

Figure 9:
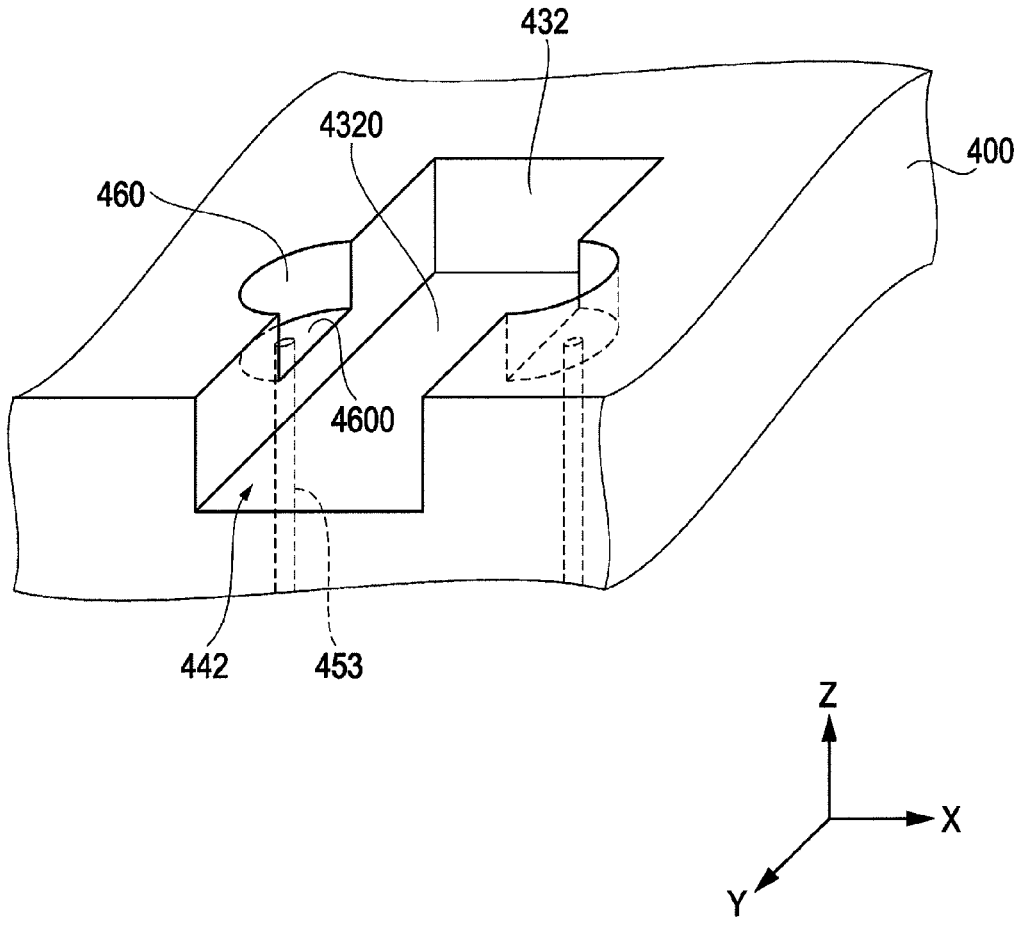
FIG. 9 is a perspective view illustrating a portion of a holder member according to a second modification.

FIG. 9 is a perspective view illustrating a portion of a holder member 400 according to a second modification.

In FIG. 9, semicircular-column-shaped notches 460 are formed in side surfaces of a buffer chamber 432 formed in the shape of a recess, at positions away from a bottom surface 4320 of the buffer chamber 432 in the direction Z (the direction opposite to the gravity direction). Air open holes 453 are provided in bottom surfaces 4600 of the notches 460. Furthermore, an opening 442 is formed in a side surface.

The second modification provides the following advantages.

(6) The notches 460 formed in the side surfaces of the buffer chamber 432 can be formed, as a part of the buffer chamber 432, simultaneously with the formation of the buffer chamber 432. Accordingly, an ink jet recording head unit 11, in which the buffer chamber 432 is easy to form, can be obtained. Furthermore, because the openings of the air open holes 453 are enclosed by the side surfaces of the notches 460, ink is less likely to enter.

Although the embodiment and the modifications have been described above, the invention is not limited thereto. For example, although the ink jet recording head unit 11 having a plurality of ink jet recording heads 1 has been described in the embodiment, the ink jet recording head unit 11 may have only one ink jet recording head 1.

Furthermore, the flexible wiring substrates are not limited to the COF substrates 210, but may be flexible substrates on which no driving circuits are mounted.

Although the above-described embodiment has been described by taking an ink jet recording head unit as an example of the liquid ejection head unit and by taking a printer as an example of the liquid ejection apparatus, the invention can be widely applicable to all kinds of liquid ejection heads and liquid ejection apparatuses, and it is of course applicable to liquid ejection heads and liquid ejection apparatuses used to eject liquid other than ink. Examples of other liquid ejection heads include colorant ejection heads used to manufacture color filters of liquid crystal displays and the like, electrode-material ejection heads used to form electrodes in organic electroluminescent (EL) displays, field emission displays (FED), etc., and living-organic-material ejection heads used to manufacture biochips. The invention is applicable to liquid ejection apparatuses having these liquid ejection heads.

The entire disclosure of Japanese Patent Application No. 2011-071848, filed Mar. 29, 2011 is incorporated by reference herein.

What is claimed is:

1. A liquid ejection head unit comprising:

a flow-path forming substrate provided with pressure generating chambers communicating with nozzle openings, through which liquid is ejected, and a manifold communicating with the pressure generating chambers;

pressure generating elements provided corresponding to the respective pressure generating chambers;

a protection substrate accommodating the pressure generating elements and provided on the flow-path forming substrate;

a damper portion facing the manifold with a compliance substrate therebetween;

a buffer chamber communicating with the damper portion;

an air open hole communicating with the damper portion and having an opening in the buffer chamber, at a position away from a bottom surface of the buffer chamber in the direction opposite to the gravity direction;

an insertion hole extending from the flow-path forming substrate to the protection substrate;

an opening provided in the buffer chamber so as to be oriented in a direction different from the direction in which the insertion hole is open;

lead electrodes that extend from electrodes formed on the pressure generating elements and are exposed in the insertion hole; and a flexible wiring substrate connected at one end to the lead electrodes with an anisotropic conductive adhesive and extending through the insertion hole.

2. The liquid ejection head unit according to claim 1, wherein a portion of the air open hole is formed so as to protrude in the buffer chamber.

3. The liquid ejection head unit according to claim 1, wherein the air open hole is formed in an inner surface of a notch formed in a side surface of the buffer chamber, at a position away from the bottom surface of the buffer chamber in the direction opposite to the gravity direction.

4. The liquid ejection head unit according to claim 1, further comprising:

a support member provided on the compliance substrate and provided with the damper portion; and a holder member provided with the buffer chamber and bonded to the top of the support member, wherein the insertion hole includes a through-hole penetrating the protection substrate in the thickness direction from the flow-path forming substrate to the support member;

a support hole continuous with the through-hole and penetrating the support member in the thickness direction from the support member to the holder member; and an opening continuous with the support hole and penetrating the holder member in the thickness direction.

5. A liquid ejection apparatus comprising the liquid ejection head unit according to claim 1.

6. A liquid ejection apparatus comprising the liquid ejection head unit according to claim 2.

7. A liquid ejection apparatus comprising the liquid ejection head unit according to claim 3.

8. A liquid ejection apparatus comprising the liquid ejection head unit according to claim 4.

* * * * *